US006403901B1

(12) United States Patent
Boeder et al.

(10) Patent No.: US 6,403,901 B1
(45) Date of Patent: Jun. 11, 2002

(54) SPRING BIASED CONTACT SYSTEM INCLUDING A ROTATABLE SYMMETRICAL CONTACT WITH TWO LEVER ARMS

(75) Inventors: Franz Boeder, Ahrbrueck; Guido Dedenbach, Bonn, both of (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/617,172

(22) Filed: Jul. 17, 2000

(30) Foreign Application Priority Data

Jul. 17, 1999 (DE) ..... 199 33 614

(51) Int. Cl.[7] ..... H01H 1/22

(52) U.S. Cl. ..... 200/244; 335/195; 218/22; 218/146

(58) Field of Search ..... 200/244, 248, 200/275, 243; 335/16, 147, 195; 218/22, 146

(56) References Cited

U.S. PATENT DOCUMENTS 4,649,247 A * 3/1987 Preuss et al. ..... 200/244
4,910,485 A * 3/1990 Bolongeat-Mobleu et al. ... 335/195
5,310,971 A * 5/1994 Vial et al. ..... 200/244
5,534,832 A * 7/1996 Duchemin et al. ..... 335/16
6,084,489 A * 7/2000 Castonguay et al. ..... 200/22 X
6,114,641 A * 9/2000 Castonguay et al. ..... 200/244
6,259,048 B1 * 7/2001 Castonguay et al. ..... 200/244

FOREIGN PATENT DOCUMENTS

| | | |
|---|---|---|
| DE | 34 31 288 | 3/1986 |
| EP | 0 174 904 | 3/1986 |
| EP | 314 540 | 10/1988 |
| EP | 0 560 697 | 9/1993 |
| EP | 889 498 | 3/1999 |

* cited by examiner

*Primary Examiner*—J. R. Scott
(74) *Attorney, Agent, or Firm*—Kenyon & Kenyon

(57) ABSTRACT

A contact system having a two-armed contact arm equipped at its opposite ends with contact pieces that can be brought into and out of contact with corresponding contact pieces of stationary busbars. The contact arm is mounted rotatably on a central bearing axis using an elongated hole, the two lever arms being acted upon by contact force springs that brace with one end against a switching shaft or a switching shaft segment. To provide a uniform contact pressure in the presence of differing wear of the contact pieces, the elongated hole extends in a direction that differs substantially from the direction perpendicular to the longitudinal axis of the contact arm and substantially from the longitudinal axis, and the longitudinal action direction of the contact force springs extends neither perpendicular to the longitudinal axis nor perpendicular to the extension direction of the elongated hole.

6 Claims, 1 Drawing Sheet

SPRING BIASED CONTACT SYSTEM INCLUDING A ROTATABLE SYMMETRICAL CONTACT WITH TWO LEVER ARMS

FIELD OF THE INVENTION

The present invention relates to a contact system having a two-armed rotatable contact arm. Contact systems of this kind are used in particular in current-limiting circuit breakers.

RELATED TECHNOLOGY

German Patent Document No. DE 34 31 288 A1 describes a contact system that has a two-armed contact arm, rotatable about a central bearing arrangement, that is equipped at each of its ends, on opposite sides of a longitudinal axis crossing the rotation axis of the bearing arrangement, with a contact piece that can be brought into and out of contact with a respective contact piece of a stationary busbar, and each of whose lever arms has associated with it a contact force torsion spring that braces against a switching shaft. The bearing arrangement of the contact arm has a bearing pin and, surrounding the bearing pin, an elongated hole whose longitudinal axis extends approximately at right angles to the longitudinal axis of the contact arm. European Patent Document No. EP 869 498 A2 describes a similar contact system having an elongated hole arranged in similar fashion, in which a contact force tension spring is arranged on each side of the contact arm. The tension springs are hooked at both ends into spring pegs that are guided in recesses, extending parallel to the elongated hole, of switching shaft segments, and act upon oppositely located engagement surfaces of the lever arms. European Patent Document No. EP 314 540 B1 describes a contact system having a two-armed contact arm that is floatingly mounted about a virtual rotation axis solely by way of the contact force springs that engage respectively on a lever arm and a switching shaft segment. The known contact systems guarantee equalization even if the contact pieces have an asymmetrically decreasing height, which occurs as a consequence of arc erosion or other wear on said contact pieces, or because of displacement of the rotation axis via the elongated hole or the floating bearing arrangement. It is disadvantageous, however, that in the event of uneven wear on the contact pieces to be associated with the oppositely located ends of the lever arms, when the contact arm is displaced, the contact force springs to be associated with the two lever arms are acted upon differently and/or engage on the lever arms with different distances with respect to the bearing axis, and therefore result in differing contact forces between the connected contact pieces. The consequence of this is moreover that the contact pressure decreases on the side with the most heavily eroded contact pieces, and thus brings about self-reinforcing additional wear on the contact pieces on that side.

SUMMARY OF THE INVENTION

It is therefore an object of the present invention to provide a contact system with uniform contact pressure in the event of differing wear on the contact pieces.

The present invention provides a contact system including a contact arm (3), including two lever arms (8; 9) and rotationally symmetrical about 180°, that is equipped at its opposite ends with contact pieces (10; 11) and is mounted with an elongated hole (5) rotatably on a central bearing axis (7). Stationary busbars (14; 15) are provided having contact pieces (12; 13) that come in contact-closing fashion into contact with, and in contact-opening fashion out of contact with, respective contact pieces (10; 11) of the contact arm (3) located opposite them. Also provided are contact force springs (17; 18) that engage respectively between each of the lever arms (8; 9) and a switching shaft or a switching shaft segment (25). The elongated hole (5) is set, opposite to the opening movement of the contact arm (3), substantially obliquely with respect to its longitudinal axis (29) which runs perpendicular to the initial opening movement of its contact pieces (10; 11) and intersects the bearing axis (7). When the contact system is closed, the action direction (26) between the engaging ends (20, 21; 22, 23) of the contact force springs (17; 18) runs substantially obliquely with respect to the longitudinal axis (29), but not perpendicular or approximately perpendicular to the extension direction (27) of the elongated hole (5).

The present invention provides an oblique incidence of the elongated hole with respect to the longitudinal axis of the contact arm, as well as an oblique alignment of the contact force springs in terms of their longitudinal applied force, i.e., the force line between the engagement points of the corresponding contact force springs on the associated lever arm of the contact arm and on the switching shaft or switching shaft segment, with respect to the longitudinal axis of the contact arm and the profile of the elongated hole. If differing wear occurs on the contact pieces on opposite sides of the contact arm, a forced displacement of the rotation axis of the contact arm thus occurs, inside the obliquely incident elongated hole and about the bearing axis, so as to result, for the contact force springs associated with the two lever arms, in deliberately provided longitudinal action directions and changes in spring length that lead to considerable equalization of the contact forces on both sides of the contact arm.

According to an embodiment of the present invention, the elongated hole is offset by a first angle of 45° to 60°, and the longitudinal action direction of the contact force springs by a second angle of 47° to 62°, with respect to the direction perpendicular to the longitudinal axis of the contact arm.

The contact force springs may be configured as tension springs; they are not limited thereto, however, but can also be used in suitable fashion for the present invention in a different configuration, for example as compression or torsion springs.

BRIEF DESCRIPTION OF THE DRAWINGS

The present invention is elaborated upon below with reference to drawings, in which.

DETAILED DESCRIPTION

Figure 1:
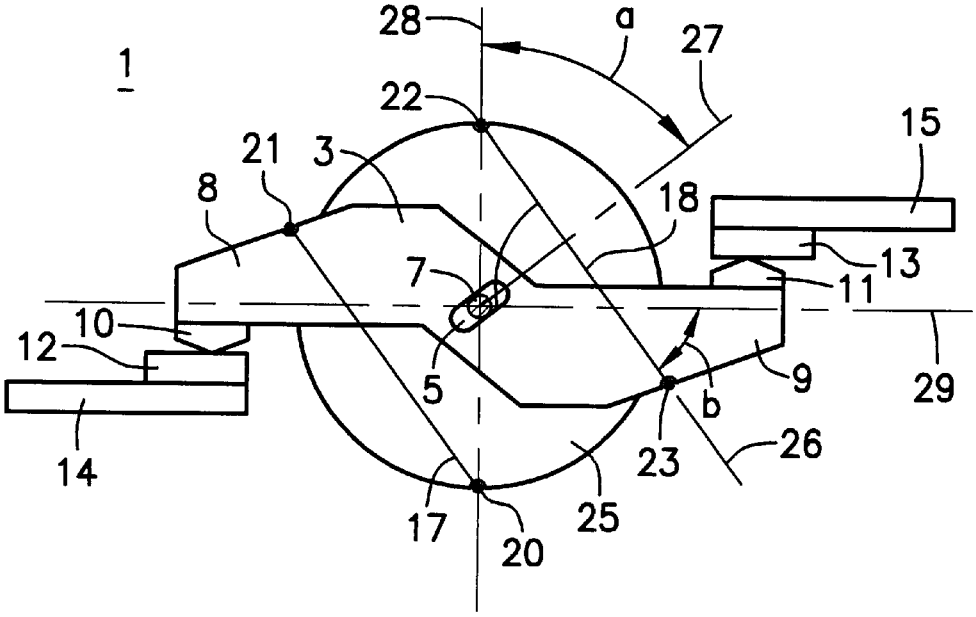
FIG. 1 shows a schematic depiction of a closed contact system according to an embodiment of the present invention when the contact pieces are in new condition.

As shown in FIG. 1, contact system 1 has a contact arm 3 that is mounted rotatably about a central bearing axis 7 by way of an elongated hole 5. The rotationally symmetrical contact arm 3 has two lever arms 8 and 9 that are respectively equipped, at their opposite ends, with a movable contact piece 10 and 11. When contact system 1 is closed, contact pieces 10, 11 come into electrical contact with respective stationary contact pieces 12, 13 each on a busbar 14, 15. The necessary contact pressure between contact piece pairs 10, 12 and 11, 13 is generated by contact force springs 17 and 18 that engage with their one end 20, 22 against a switching shaft segment 25 and with their other end 21, 23 against one of lever arms 8 and 9. In the Figures, contact force springs 17, 18 are symbolically depicted as tension springs; they can also, however, have other configurations whose longitudinal action direction 26 passes in each case through the engagement points or ends 20, 21 and 22, 23. Two contact force springs are arranged on each of the two sides of contact arm 3, of which only contact force springs 17 and 18, arranged in front of contact arm 3 in terms of the plane of the drawing, are visible in the Figures. Elongated hole 5 extends in a direction 27 that, in the opening rotation direction of contact arm 3 (i.e., clockwise in FIG. 1), not only differs substantially from direction 28 that is perpendicular to longitudinal axis 29 of contact arm 3 and to bearing axis 7, but also differs substantially from longitudinal axis 29. Action direction 26 of contact force springs 17 and 18 extends neither perpendicular (or approximately perpendicular) to longitudinal axis 29 of contact arm 3, nor perpendicular (or approximately perpendicular) to extension direction 27 of elongated hole 5.

Figure 2:
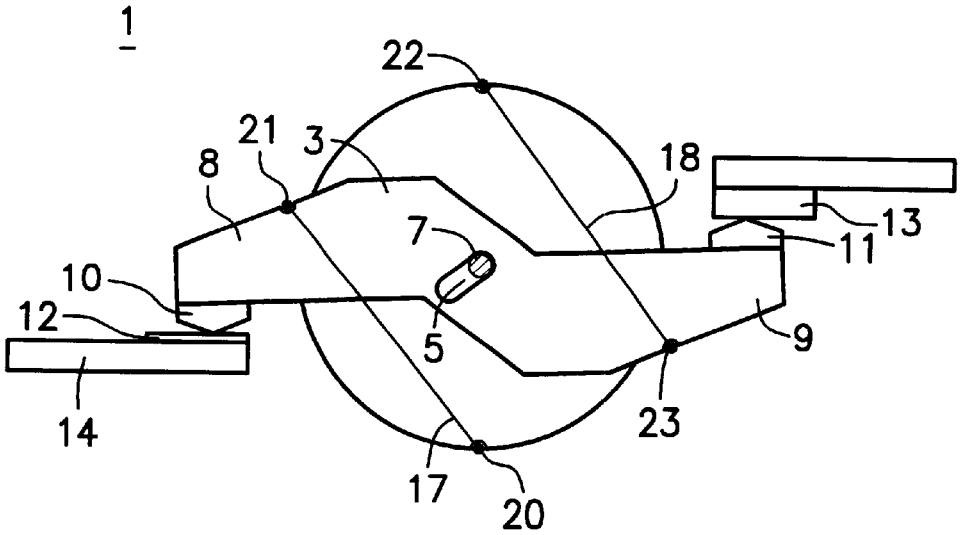
FIG. 2 shows the embodiment of FIG. 1 after differing amounts of wear have occurred on the contact pieces.

FIG. 2 shows the closed contact system 1 when the stationary contact piece 12 of busbar 14 has been subjected to almost complete wear, whereas the other contact pieces 10, 11, and 13 are still completely intact. Under the action of contact force springs 17 and 18, a displacement of contact arm 3 along elongated hole 5 about bearing axis 7 is accomplished, continuing to ensure a reliable contact between contact piece pairs 10, 12 and 11, 13. The above-described extension direction 27 of elongated hole 5, action direction 26 of contact force springs 17 and 18 (FIG. 1), and the change in spring lengths forced by the extension direction of elongation hole 5 ensure, in combination, that in response to the forced displacement of elongated hole 5 on bearing axis 7, contact force springs 17 and 18 exert a force of approximately equal magnitude on contact piece pairs 10, 12 and 11, 13. In the example shown in FIG. 2, contact force springs 17 on the side of the worn contact piece 12 are stretched less than contact force springs 18 on the side of the unworn contact pieces 11 and 13, but this difference is less than in previous devices. As a result, the spring force acting between ends 20 and 21 of contact force springs 17 continues to be less than that between ends 22 and 23 of contact force springs 18; but because of the forced displacement of contact arm 3 about bearing axis 7, the lesser spring force of contact force spring 17 is compensated for by a greater effective lever as compared to the effective lever pertaining to contact force spring 18, which also extends substantially along longitudinal axis 29. Thus even in the event of extremely asymmetrical wear on contact pieces 10 through 13, sufficiently uniform distribution of the contact forces among contact piece pairs 10, 12 and 11, 13 of contact system 1 is provided. It has been found that maintenance of a contact force of equal magnitude between contact piece pairs 10, 12 and 11, 13 is best achieved if, when contact pieces 10 through 13 are in new condition, the first angle a between direction 28 perpendicular to longitudinal axis 29 and extension direction 27 of elongated hole 5 has a value, in the opening rotation direction of contact arm 3, in the range from 45° to 60°, preferably 52°; and if the second angle b between longitudinal axis 29 and action direction 26 of contact force springs 17, 18 has a value, in the opening rotation direction, in the range of 47° to 62°, preferably 54°.

What is claimed is:

1. A contact system comprising:

a rotationally symmetrical contact arm defining an elongated hole for rotatably mounting the contact arm about a central bearing axis, the contact arm including two lever arms, each lever arm including a respective first contact piece disposed at a respective opposite end;

two stationary busbars each including a respective second contact piece, each respective second contact piece disposed opposite a respective one of the first contact pieces for coming into contact in a contact-closing manner with the respective first contact piece and for coming out of contact in a contact-opening manner with the respective first contact piece; and two contact force springs, each of the contact force springs engaging at respective engaging ends of the respective contact force spring a respective one of the lever arms and a switching shaft or switching shaft segment; wherein the contact arm defines a longitudinal axis and the elongated hole defines an extension direction axis and at least one of the contact force springs defines an action direction axis between its respective engaging ends, the longitudinal axis being aligned perpendicular to a first direction of an initial opening movement of the first contact pieces, the extension direction axis being aligned substantially obliquely with respect to the longitudinal axis and intersecting the central bearing axis, and, when the contact system is in a closed position, the action direction axis being aligned substantially obliquely with respect to the longitudinal axis and not perpendicular or approximately perpendicular to the extension direction axis.

2. The contact system as recited in claim 1 wherein the contact arm is rotationally symmetrical about 180°.

3. The contact system as recited in claim 1 wherein the extension axis direction is aligned substantially obliquely with respect to the longitudinal axis in an angular direction opposite an angular direction of an opening movement of the contact arm.

4. The contact system as recited in claim 1 wherein the extension direction axis is aligned at a first angle having a range from 45° to 60° with respect to a second direction perpendicular to the longitudinal axis and wherein the action direction axis is aligned at a second angle having a range from 47° to 62° with respect to the longitudinal axis.

5. The contact system as recited in claim 4 wherein the first angle is from the direction perpendicular to the longitudinal axis in the angular direction of the opening movement of the contact arm.

6. The contact system as recited in claim 1 wherein the contact force springs include tension springs.

* * * * *